US009408763B2

(12) United States Patent
Purdue et al.

(10) Patent No.: US 9,408,763 B2
(45) Date of Patent: Aug. 9, 2016

(54) WHEELCHAIR WITH USER CONTROLLED TILT MECHANISM

(71) Applicants: Carole Purdue, Centreville, MD (US); Christopher Dykes, Columbus, MD (US)

(72) Inventors: Carole Purdue, Centreville, MD (US); Christopher Dykes, Columbus, MD (US)

( * ) Notice: Subject to any disclaimer, the term of this patent is extended or adjusted under 35 U.S.C. 154(b) by 0 days.

(21) Appl. No.: 14/398,897

(22) PCT Filed: May 1, 2013

(86) PCT No.: PCT/US2013/039043

§ 371 (c)(1),
(2) Date: Nov. 4, 2014

(87) PCT Pub. No.: WO2013/166134

PCT Pub. Date: Nov. 7, 2013

(65) Prior Publication Data

US 2015/0137548 A1 May 21, 2015

Related U.S. Application Data

(60) Provisional application No. 61/687,953, filed on May 4, 2012.

(51) Int. Cl.

| | |
|---|---|
| ***B62B 7/00*** | (2006.01) |
| ***A61G 5/10*** | (2006.01) |
| *A61G 5/12* | (2006.01) |

(52) U.S. Cl.

CPC ..... *A61G 5/1075* (2013.01); *A61G 2005/121* (2013.01); *A61G 2005/125* (2013.01)

(58) Field of Classification Search

CPC ..... A61G 5/1075
USPC ..... 280/47.41, 250.1; 180/65.1; 297/316, 297/325

See application file for complete search history.

(56) References Cited

U.S. PATENT DOCUMENTS

| | | | | | |
|---|---|---|---|---|---|
| 4,893,827 | A * | 1/1990 | Gay | A61G 5/00 | 280/250.1 |
| 5,044,647 | A * | 9/1991 | Patterson | A61G 5/00 | 180/907 |
| 5,240,277 | A * | 8/1993 | Scheulderman | A61G 5/00 | 280/250.1 |
| 5,294,141 | A * | 3/1994 | Mentessi | A61G 5/00 | 188/2 F |
| 5,513,867 | A | 5/1996 | Bloswick et al. | | |
| 5,718,442 | A * | 2/1998 | Alexander | A61G 5/10 | 280/250.1 |
| 5,957,474 | A * | 9/1999 | Mundy | A61G 5/00 | 280/250.1 |
| 5,971,482 | A * | 10/1999 | Goertzen | A61G 5/00 | 297/322 |
| 5,996,716 | A * | 12/1999 | Montiglio | A61G 5/045 | 180/6.5 |
| 6,003,891 | A * | 12/1999 | Broadhead | A61G 5/045 | 180/907 |
| 6,068,280 | A * | 5/2000 | Torres | A61G 5/045 | 180/328 |
| 6,126,186 | A * | 10/2000 | Mascari | A61G 5/12 | 280/220 |
| 6,131,940 | A * | 10/2000 | Arnoth | A61G 5/00 | 280/250.1 |

(Continued)

*Primary Examiner* — Jeffrey J Restifo
(74) *Attorney, Agent, or Firm* — Klauber & Jackson LLC

(57) ABSTRACT

A manual wheelchair having a tilt mechanism that allows a user positioned on the wheelchair to control the tilt angle of the wheelchair seat. The manual wheelchair has a base frame with arm rests that are fixed in position with respect to the base frame. The tilt mechanism includes a controller that is affixed to the manual wheelchair at a location proximate to one of the arm rests within the ready reach of the user and which can be manipulated by the user without assistance from a caregiver to allow the seat of the manual wheelchair to freely pivot about a pivot point such that the user can locate the seat at a desired tilt angle by pushing or pulling on the arm rest. A further manipulation of the controller allows the user to lock the seat in the desired tilt angle and remain in that angle.

20 Claims, 4 Drawing Sheets

(56) References Cited

U.S. PATENT DOCUMENTS 6,203,106 B1 * 3/2001 Nearing ..... A61G 5/107 297/284.9
6,250,661 B1 * 6/2001 Dickie ..... A61G 5/045 280/304.1
6,257,609 B1 * 7/2001 O'Neill, Sr. ..... A61G 5/107 280/250.1
6,357,776 B1 * 3/2002 Goertzen ..... A61G 5/00 180/907
6,409,265 B1 * 6/2002 Koerlin ..... A61G 5/006 297/325
6,425,635 B1 * 7/2002 Pulver ..... A61G 5/107 297/325
6,447,064 B1 * 9/2002 Mundy ..... A61G 5/00 297/313
6,588,792 B1 * 7/2003 Koerlin ..... A61G 5/006 280/304.1
6,705,629 B2 3/2004 Post et al.
6,715,784 B2 * 4/2004 Koerlin ..... A61G 5/006 280/304.1
6,776,430 B2 * 8/2004 White ..... A61G 5/045 180/907
6,883,773 B1 4/2005 Mattheis
8,186,695 B2 * 5/2012 Moller ..... A61G 5/08 280/47.25
8,235,407 B2 * 8/2012 Cerreto ..... A61G 5/1075 280/250.1
8,297,641 B2 * 10/2012 Landry ..... A61G 5/1075 280/200
8,322,741 B2 * 12/2012 Laslo ..... A61G 5/10 280/220
8,419,130 B2 * 4/2013 Bergman ..... A61G 5/042 180/907
8,985,618 B2 * 3/2015 Perk ..... A61G 5/02 280/250.1
9,010,787 B2 * 4/2015 Slagerman ..... A61G 5/1075 280/250.1
2002/0030350 A1 3/2002 Brotherston
2003/0090089 A1 * 5/2003 Koerlin ..... A61G 5/006 280/650
2004/0046358 A1 * 3/2004 White ..... A61G 5/045 280/304.1
2007/0102615 A1 * 5/2007 Engman ..... A61G 5/1075 248/371
2009/0230652 A1 * 9/2009 Landry ..... A61G 5/1075 280/250.1
2015/0137548 A1 * 5/2015 Purdue ..... A61G 5/1075 296/65.08

* cited by examiner

WHEELCHAIR WITH USER CONTROLLED TILT MECHANISM

CROSS REFERENCE TO RELATED APPLICATIONS

The present application is a National Stage Application claiming the priority of PCT Application No. PCT/US2013/039043 filed May 1, 2013, which in turn, claims priority from U.S. Provisional Application Ser. No. 61/687,953 filed May 4, 2012. Applicants claim the benefits of 35 U.S.C. §120 as to the PCT Application and priority under 35 U.S.C. §119 as to the said U.S. Provisional application, and the entire disclosures of both applications are incorporated herein by reference in their entireties.

FIELD OF THE INVENTION

The present invention relates to a manual tilt wheelchair having a seat that can be tilted and, more particularly, to a manual wheelchair having a seat that can be adjusted in its angular orientation by the user without assistance by a caregiver.

BACKGROUND OF THE INVENTION

A tilt-in-space wheelchair provides the necessary change in position for the user who cannot effectively shift their body weight or change their position. These individuals are at a higher risk for skin breakdown and their sifting tolerance is compromised. A typical tilt-in-space wheelchair frame tilts up to 45 degrees from horizontal while maintaining the same back to seat angle. This feature provides a change in position for those people who have a difficult time maintaining their pelvic, trunk, and head position against gravity for extended periods of time. This feature can also assist in preventing postural collapse which puts them at risk for respiratory or digestive complications. Individuals who suffer from postural hypotension also benefit from tilt-in-space chairs.

Despite the fact that the wheelchair industry offers several models with a tilting seating system, no manual wheelchairs currently on the market are designed so that the user can tilt independently, that is, none can be tilted without the assistance of an attending caregiver. Tilt wheelchairs were designed so that the user's body can be angled at various degrees so that pressure points are redistributed and their upper body can be positioned for optimal posture and comfort. The existing manual tilt wheelchairs have to be activated by a caregiver with the control located in the back of the chair, or to the side, out of the users reach. They are also designed with the armrest and seat attached to each other, therefore, the design does not give the user a place to push and pull from to activate the tilt feature.

The average wheelchair user spends 8-14 hours in their wheelchairs daily. These individuals who spend these extended hours in a static upright position often end up needing additional medical treatments. They are at risk for pressure ulcers, skin tears, skeletal deformities (specifically kyphosis or "C" curve posture), impaired respiration and digestion from forward flexed postures, joint contractures, pain and discomfort, agitation, decreased mobility, and falls, which can result in injuries.

For the average, able-bodied person, relief from discomfort during prolonged sitting is made by frequent, small, unconscious body adjustments that maintain comfort levels. For persons with physical disabilities and generalized muscle weakness, the discomfort and pain from daily wheelchair sitting can be chronic and debilitating. In addition to the potential for developing decubitus ulcers, many people in this population experience intolerable periods of discomfort and pain, which can lead to reduced participation in daily activities including, work, education, and recreation, and retrieval. (D. Hobson & Barbara Crane: State of the Science White Paper on Wheelchair Seating Comfort Feb. 9, 2001)

According to the National Pressure Ulcer Advisory Panel (NPUAP) the treatment costs for patients who developed ulcers were estimated to be as much as $6 billion per year. In elderly populations and in those who are institutionalized, pressure ulcers are one of the most costly diseases to treat. These ulcers add an estimated burden of over $1 billion in expenditures and an additional 2.2 million Medicare hospital days to the United States healthcare system. The bottom line alone, without considering the cost of human suffering, demonstrates the importance of preventing pressure ulcers.

Accordingly, it would be advantageous to have a manual wheelchair with a user controlled seat tilt mechanism that can be readily operated by the user while sitting in the wheelchair without the need for assistance of a caregiver so as to allow the user to make desired adjustments to the angular orientation of the seat of the wheelchair.

SUMMARY OF THE INVENTION

The present invention is therefore directed to a manual wheelchair where the user has full control of the tilt angle of the wheelchair seat. As used herein the term "user" will mean the patient or person actually seated in and supported by the wheelchair. As also used herein, the wheelchair is described as a "manual wheelchair" and that means that the wheelchair is propelled solely by the user and no external motive system is employed.

With the present invention, the user can independently perform the tilt operation on the wheelchair so that the user can execute pressure relief and postural changes throughout the day in order to maintain optimal comfort and skin integrity during the many hours spent in the wheelchair without assistance from a caregiver.

The wheelchair is designed to have a base frame with a seat that pivots backward and forward with respect to the base frame and is also provided with a user controlled actuator that can be released to allow the seat to freely tilt about the base frame as well as to again lock the seat in the desired tilt angle selected by the user.

Unlike other tilt wheelchairs, the armrests of the present manual wheelchair are fixed to the base frame instead of the seat in order to provide the user with a fixed structure to push and pull against while tilting the seat. This allows the user to operate a controller that is located proximate to at least one of the arm rests to allow the user to use the stability of one or both of the armrests to tilt the seat by pushing and/or pulling on an armrest for leverage to independently tilt the seat of the wheelchair. Releasing the controller automatically relocks the system into position. No assistance is required from a caregiver to adjust the angle of the seat of the wheelchair.

Other features of the tilt mechanism of the present invention will become more apparent in light of the following detailed description of a preferred embodiment thereof and as illustrated in the accompanying drawings.

BRIEF DESCRIPTION OF THE DRAWINGS

FIG. 4 is a schematic view illustrating the control system for a hydraulic cylinder used with the tilt mechanism of the present invention; and.

DETAILED DESCRIPTION OF THE INVENTION

Figure 1:
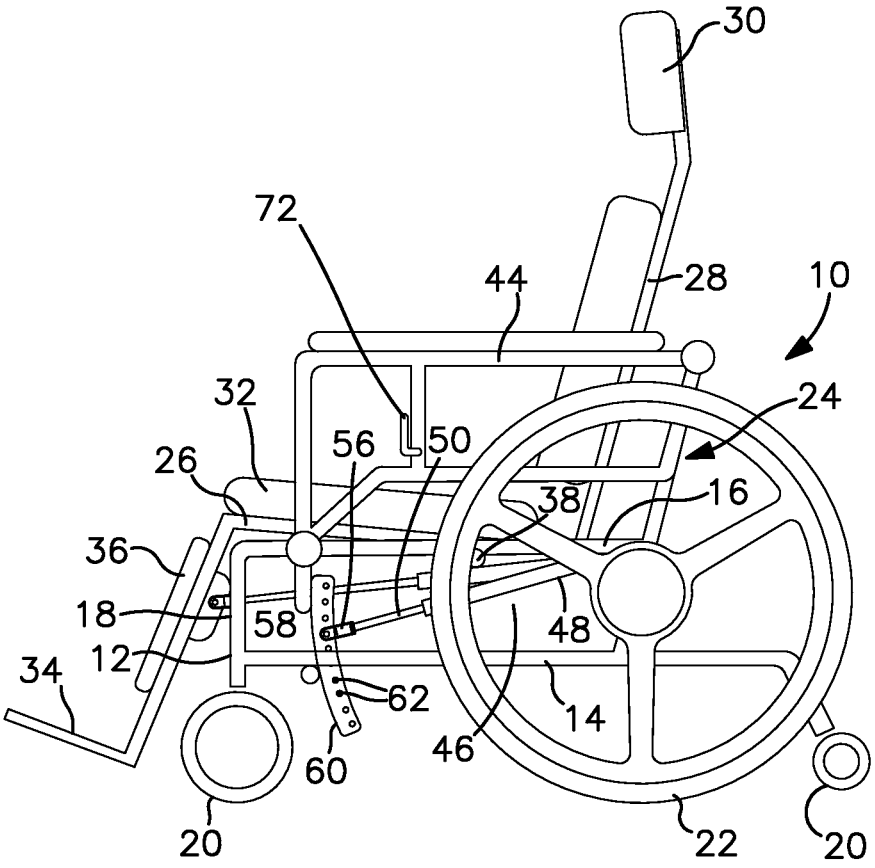
FIG. 1 is a side view of a wheelchair having the tilt mechanism of the present invention with the seat in its upright position.
Figure 2:
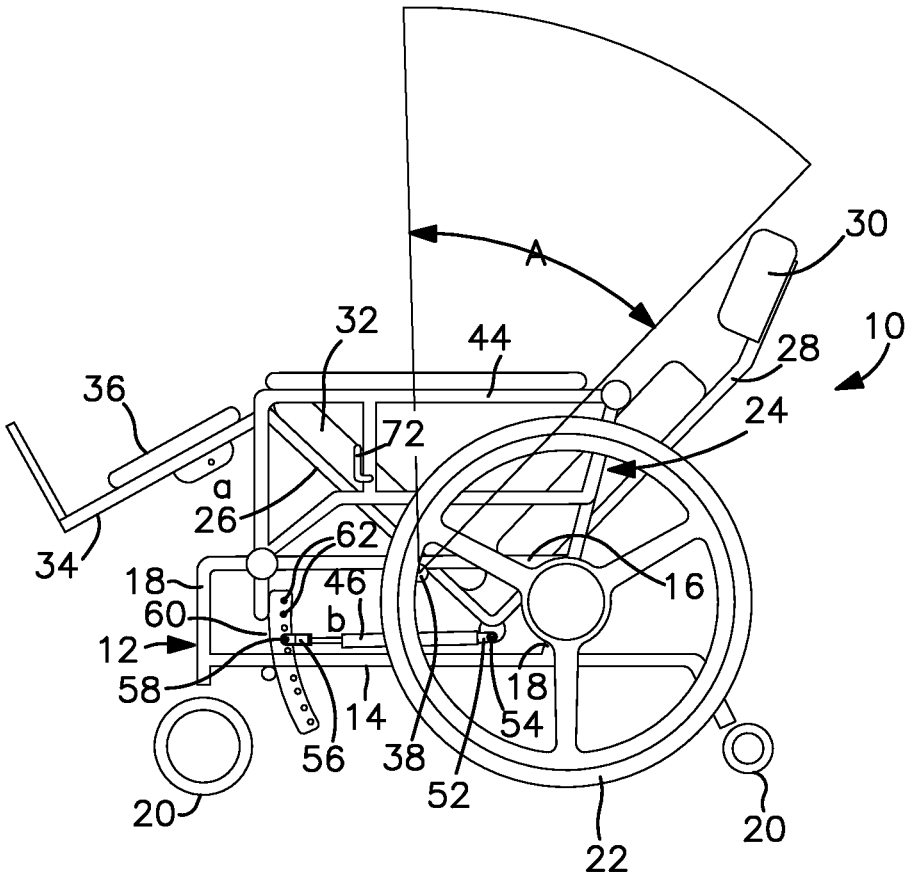
FIG. 2 is a side view of the wheelchair of FIG. 1 with the seat in its tilted position.

Referring to FIGS. 1 and 2, there is shown side views of a wheelchair 10 having a tilt mechanism constructed in accordance with the present invention. As can be seen, the wheelchair 10 is made up of a base frame 12 that may include lower horizontal members 14 as well as upper horizontal members 16 joined by vertical members 18. As will be described, only one side of the wheelchair 10 that appears in FIGS. 1 and 2 will be described, however it is well known that an opposite side of the wheelchair 10 is present and which is similar to or a mirror image of the side shown in FIGS. 1 and 2.

There may also be conventional wheels 20 located at the bottom of the base frame 12 to enable the wheelchair 10 to be freely movable along a planar surface.

A pair of drive wheels 22 are also provided (again, only one of which is shown in the Figures) and which enable the user to move the wheelchair 10 in a desired direction and the drive wheels 22 may be grasped by the user of the wheelchair 10 or by a caregiver, or by some other propulsion system so as to cause rotation of the drive wheels 22 to move the wheelchair 10.

A seat 24 is pivotally affixed to the base frame 12 so as to be rotatable about a pivot point in order to allow the seat 24 to be tilted to a desired orientation. In an exemplary embodiment, the seat 24 is comprised of a seat frame including a bottom seat frame member 26 and a back seat frame member 28 that are generally L-shaped so that the seat 24 can comfortably accommodate and support a user.

The bottom seat frame member 26 and back seat frame member 28 can be individual members affixed together or can be a unitary member that is bent into the proper shape. Again, as is conventional, there is a similar bottom seat frame member and back seat frame member located on the opposite side to the wheelchair 10 as well as horizontal members that are secured together in making up the seat 24.

There is also included a head rest 30 and a bottom cushion 32 for the comfort of the user and which are affixed to frame members of the seat 24. The seat 24 may also include a leg rest 34 that includes a leg cushion 36, again, for the comfort of the user.

As can now be seen, the seat 24 is affixed to the base frame 12 such that the seat 24 pivots about a pivot point 38 while retaining its L-shaped configuration to support the user.

Figure 3:
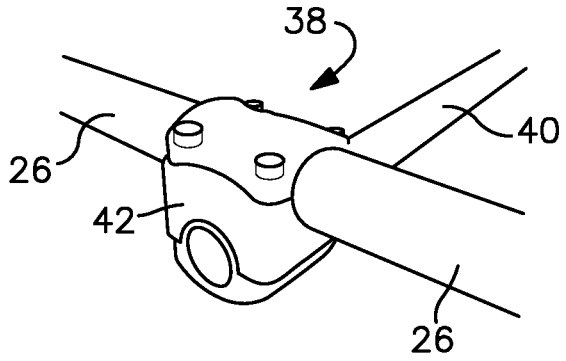
FIG. 3 is an enlarged perspective view illustrating the pivot point for the seat.

Turning briefly to FIG. 3, taken along with FIGS. 1 and 2, there can be seen an enlarged perspective view of the pivot point 38 where the seat 24 is pivotally affixed to the base frame 12. In FIG. 3 there can be seen a cross member 40 that spans the width of the wheelchair 10 and connects to the bottom seat frame members 26 on each side of the wheelchair 10.

A coupling 42 connects the cross member 40 to each bottom seat frame member 26 so that the bottom seat frame member 26 can rotate with respect to the cross member 40 in order to allow the seat 24 to tilt with respect to the base frame 12.

As can now be seen, the seat 24 can pivot about the pivot point 38 to enable the seat 24 to move to various tilt positions and, in FIG. 1, the seat 24 is in the upright position and in FIG. 2, the seat 24 has been moved to a tilted position. In an exemplary embodiment, the tilt angle A (FIG. 2) of the seat 24 between its upright position and its maximum tilt position is about 45 degrees.

The present invention includes a tilt mechanism that allows the user to control the amount of tilt of the seat 24. As previously explained, the tilting of the seat 24 is controllable by the user by simply grasping onto the arm rest 44 and using that grip on the arm rest 44 as a steady site to move the seat 24 to the desired tilt angle. The arm rest 44 is not movable with respect to the seat 24 but is fixed with respect to the base frame 12. In this manner, the user can grip the immovable arm rest 44 and use it for leverage to tilt the seat 24 about the pivot point 38 to the desired tilt angle.

Once the desired tilt angle A has been attained, the tilt mechanism allows the user to lock the seat 24 firmly at that tilt angle. As such, the tilt mechanism includes a linear actuator 46 that is connected between the seat 24 and the base frame 12. In the exemplary embodiment, the linear actuator can be a locking gas spring and one conventional locking gas spring that can be used is commercially available from Suspa Holding GmbH of Altdorf, Germany. Such locking gas spring is a combination spring and locking mechanism. The linear actuator 46 of the exemplary embodiment comprises an outer cylinder 48 and a piston 50 movably located therein. The linear actuator 46 has one end 52 affixed to the seat 24 at a location 54 along the bottom seat frame member 26 that is displaced a linear distance away from the pivot point 38 and the other end 56 is attached at a fixed location 58 with respect to the base frame 12.

The fixed location 58 is on a support bracket 60 that is solidly affixed to the base frame 12 and the support bracket 60 is an arcuate or curved bracket having a plurality of openings 62 formed therealong. Accordingly, the other end 56 of the hydraulic cylinder 46 can be attached to the support bracket 60 at any of the openings 62 so that the hydraulic cylinder 46 can be set in order to compensate or adjust for the weight of the user. With the use of the support bracket 60, the other end 56 of the linear actuator 46 can be affixed to a selected opening 62 in the support bracket 60 depending upon the weight of the user.

Accordingly, as the seat 24 is tilted by the user, the piston 50 moves inwardly or outwardly with respect to the outer cylinder 48 to contract or extend the liner actuator 46. The movement of the piston 50 is controlled so that it can be allowed to freely move or be prevented from movement such that the angle A of the seat 24 can also be controlled, that is, when the piston 50 is free to move within the outer cylinder 48, the seat 24 can be moved by the user to a desired tilt angle and when the piston 50 is prevented from moving within the outer cylinder 48, the seat 24 will be retained and held in whatever angle has been set by the user.

Figure 4:
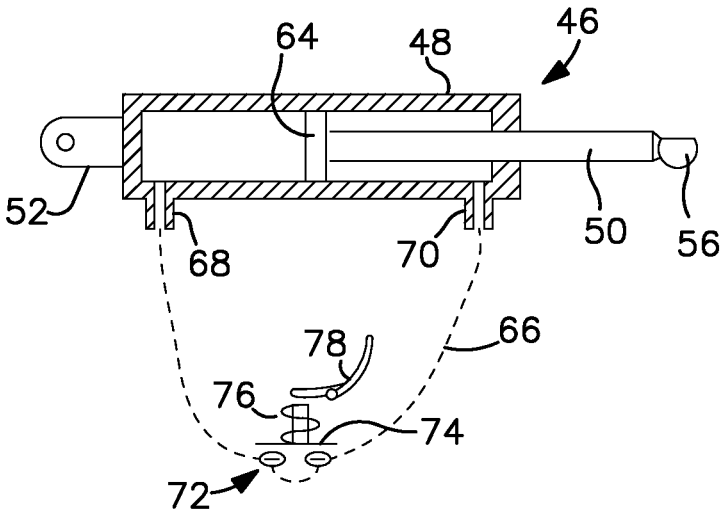

Turning then to FIG. 4, there is shown a schematic view of an exemplary system that can be used to control the movement or non-movement of the piston 50 within the outer cylinder 48. As can be seen, the hydraulic cylinder 46 includes the outer cylinder 48 and the piston 50 having a piston head 64. A hydraulic line 66 is shown in dotted lines and which forms a closed loop between a port 68 on one side of the piston head 64 and another port 70 that is located on the other side of the piston head 64. As such, as the piston 50 moves in either direction within the outer cylinder 48, the hydraulic fluid readily flows through the closed loop of the hydraulic line 66 such that the piston 50 is free to move within the outer cylinder 48.

There is, however, a controller 72 that can be activated by the user to close the hydraulic line 66 by pinching the hydraulic line 66 to stop the flow of hydraulic fluid therein, and which renders the piston 50 immovable within the outer cylinder 48.

As such, the controller 72 may include a pinch member 74 that is spring biased by means of a spring 76 to its closed position pinching the hydraulic line 66 to prevent movement of the piston 50 within the outer cylinder 48. The controller 72 may comprise a lever 78, operable, by the user of the wheelchair 10 to move the pinch member 74 against the bias of spring 76 to open the hydraulic line 66 to allow the piston 50 to move within the outer cylinder 48.

The controller 72 can be located on the wheelchair 10 within ready reach of the user of the wheelchair 10 proximate to the arm rest 44, such as attached to the arm rest 44 so that the user can simply move the actuator 72 to its open position to open the hydraulic line 66 so that the piston 50 can move and the user can adjust the tilt angle of the seat 24 to any desired position using the leverage of the arm rest 44. By locating the controller 72 proximate to the arm rest 44, the user can release the controller 72 and then, since the arm rest 44 is fixed with respect to the base frame 12 and therefore does not move when the seat 44 is tilted, the user can use the leverage provided by the fixed arm rest 44 to push or pull on the arm rest 44 to move the seat 24 to the desired tilt angle.

As can be seen, while the present controller 72 controls the flow of hydraulic fluid to allow the piston 50 to move and to be prevented from moving, other types of controllers can be used, including air activated controllers that are activated by the breath of a user.

When the user has the seat 24 in the desired tilt angle, the user simply releases the actuator 72 so that the actuator 72 moves the actuator 72 to its closed position and stops the flow of the hydraulic fluid in the hydraulic line 66 and thereby holds the piston 50 in that exact position thereby retaining the angular orientation of the seat 24 as desire by the user.

According as can now be seen, the patient or user has full control of the angular tilt of the seat 24 and the user can simply activate the actuator 72 to open the flow of hydraulic fluid in the hydraulic line 66 to allow the user to move the seat 24 to any desired tilt angle, and, when that tilt angle has been realized, the user can release the actuator 72, thereby stabilizing the piston 50 and the seat 24 to maintain the particular tilt angle.

Figure 5:
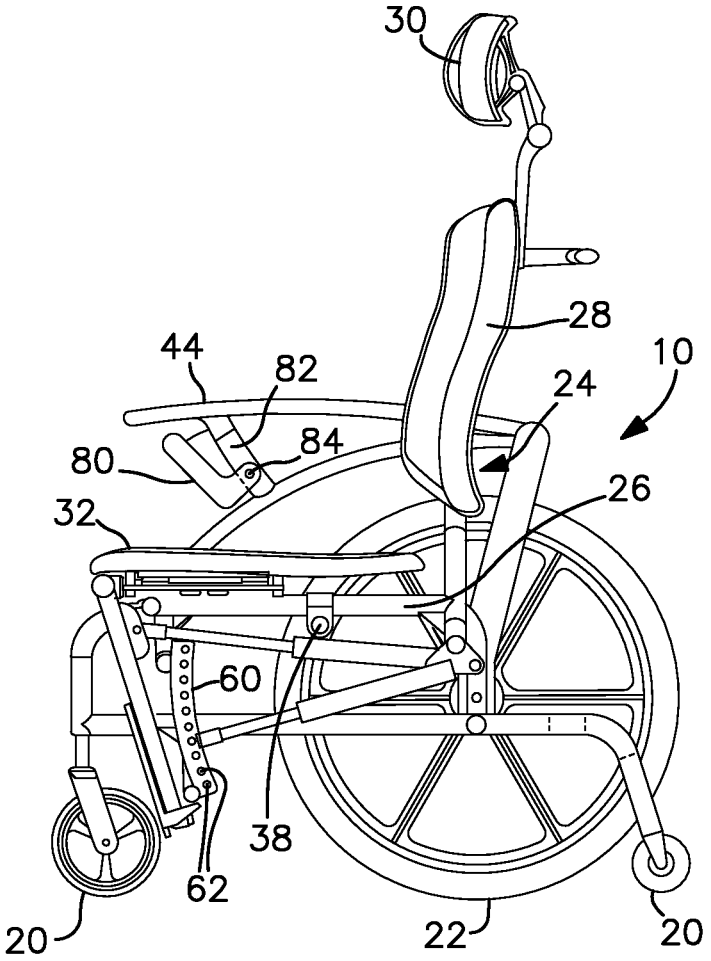
FIG. 5 is a side view of the wheelchair of FIG. 1 illustrating the system for compensating for the weight of a user.

Turning to FIG. 5, there is shown a side view of the wheelchair 10 with the seat 24 in its upright position. In FIG. 5, there can be seen a controller 80 that is positioned at a location that is convenient to the user and is pivotally affixed to a stmt 82 that is fixed to the arm rest 44 at a pivot point 84 on that strut 82. In the location as shown, the controller 80 is located so that the user can operate the controller 80 to control the tilt angle of the seat 24. Due to the location of the controller 80 proximate to and just underneath the arm rest 44, the user can activate the controller 80 while gripping the arm rest 44 to use the arm rest 44 to move the seat 24 to the desired tilt angle, and then release the controller 80 to retain the seat 24 at that angle.

The present invention also includes a compensation system to compensate or adjust for the weight of the user seated in the seat and that compensation system can be carried out in different ways. One way is to change location of the pivot point 38 with respect to the base frame 12. In the exemplary embodiment, the location of the pivot point 38 can be moved (see FIG. 3) by loosening the coupling 42 and simply moving the coupling 42 along the bottom seat frame member 26 and re-tightening the coupling when the pivot point 38 has been moved to a desired position. By moving the pivot point 38 forward and rearward, compensation can be made for the weight of the user. If the user seated in the wheelchair 10 is light, the pivot point 38 can be moved forward; if heavy, the pivot point 38 can be moved rearwardly.

In addition, as explained, the other end 56 of the hydraulic cylinder 46 can be moved with respect to the base frame 12 to a selected opening 62 in the support bracket 60. For a light user, an opening can be selected in the upper part of the support bracket and, for a heavier user, the selected opening 62 can be moved to a lower located opening 62.

While the present invention has been set forth in terms of a specific embodiment, or embodiments, it will be understood that the present tilt mechanism for a wheelchair herein disclosed may be modified or altered by those skilled in the art to other configurations. Accordingly, the invention is to be broadly construed and limited only by the scope and spirit of the claims appended hereto.

What is claimed is:

1. A tilt mechanism for adjusting the tilt angle of the seat of a manual wheelchair supporting a user, the wheelchair having a base frame, a pair of arm rests that are immovably fixed in position with respect to the base frame and a seat pivotally affixed to the base frame at a pivot point, the tilt mechanism comprising an actuator having a first end affixed to the seat at a location displaced a linear distance from the pivot point and a second end affixed to the base frame, the actuator being extendable and contractible as the seat is tilted about the pivot point and a controller located proximate to at least one of the arm rests, the controller being operable by a user supported by the wheelchair between a first position wherein the actuator is free to contract and extend and a second position wherein the actuator is prevented from contracting and extending.

2. The tilt mechanism of claim 1 wherein the actuator is a linear actuator.

3. The tilt mechanism of claim 2 wherein the linear actuator is a locking gas spring.

4. The tilt mechanism of claim 2 wherein the liner actuator has a closed loop hydraulic line that, when open, allows the linear actuator to extend and contract and wherein the controller controls the flow of hydraulic fluid with the closed loop.

5. The tilt mechanism of claim 4 wherein the controller has a pinch member that moves between an open position where the pinch member is displaced away from the hydraulic line so as to allow the hydraulic fluid to flow in the hydraulic line and a closed position wherein the pinch member pinches the hydraulic line to prevent flow of hydraulic fluid therein.

6. The tilt mechanism of claim 5 wherein the pinch member is biased toward said closed position.

7. The tilt mechanism of claim 6 wherein the bias exerted on the pinch member is a spring bias.

8. The tilt mechanism of claim 1 further including a compensation system to adjust the tilt mechanism in accordance with the weight of a user.

9. A manual wheelchair having a tiltable seat operable by a user positioned on the wheelchair, the wheelchair comprising a base frame, a pair of arm rests that are immovably fixed in position with respect to the base frame, the seat pivotally affixed to the base frame to rotate about a pivot point, a tilt mechanism including a controller mounted to the wheelchair in a position proximate to at least one of the arm rests and operable by the user positioned on the wheelchair to allow the user to tilt the seat by pushing or pulling on at least one of the arm rests to tilt the seat to a desired tilt angle and retain the seat in the desired tilt angle.

10. The manual wheelchair of claim 9 wherein the tilt mechanism includes a linear actuator having a first end affixed to the seat at a point displaced a linear distance from the pivot point and a second end affixed to the base frame, the linear actuator adapted to expand and contract as the tilt angle of the seat is changed, wherein the controller can be moved by the user to a first position wherein the linear actuator can expand and contract and a second position wherein the linear actuator is prevented from expanding and contracting.

11. The manual wheelchair of claim 10 wherein the controller is biased toward said second position.

12. The manual wheelchair of claim 10 wherein the linear actuator comprises a piston within an outer cylinder and a hydraulic line such that the piston is movable within the outer cylinder when the hydraulic line is open and the piston cannot move when the hydraulic line is closed, and wherein the controller controls the opening and closing of the hydraulic line.

13. The manual wheelchair of claim 10 wherein the second end of the linear actuator is movable between a plurality of positions affixed to the base frame to adjust the length of the linear actuator.

14. The manual wheelchair of claim 9 wherein the wheelchair further includes a compensation system to adjust the tilt mechanism in accordance with the weight of a user.

15. The manual wheelchair of claim 14 wherein the compensation system includes a support bracket affixed to base frame, the support bracket having a plurality of openings, each opening adapted to connect to the second end of the linear actuator.

16. The manual wheelchair of claim 14 where the compensation system includes a means to move the pivot point of the seat.

17. A method of controlling the tilt angle of the seat of a manual wheelchair, the method comprising the steps of:

providing a wheelchair having a base frame, a seat pivotally mounted to the base frame at a pivot point, a pair of arm rests immovable affixed to the base frame for supporting the arm of a user, and a controller located proximate to the at least one arm rest, providing a linear actuator that is affixed to the base frame and the seat at a point displaced a linear distance from the pivot point, the linear actuator adapted to expand and contract as the seat is pivoted about the pivot point, and using the controller to control the linear actuator to allow the linear actuator to expand and contract and to prevent the linear actuator from expanding and contracting.

18. The method of claim 17 wherein the step of providing a linear actuator comprises providing a piston within a cylinder and a passage for fluid between each ends of the piston within the cylinder and the step of controlling the linear actuator comprises controlling the flow of fluid within the passage.

19. The method of claim 17 further including the step of moving the location of the pivot point to compensate for the weight of a user seated in the wheelchair.

20. The method of claim 17 further including the step of adjusting the movement of the linear actuator depending on the weight of a user.

* * * * *